US008596010B2

(12) United States Patent
Hohmann, Jr.

(10) Patent No.: US 8,596,010 B2
(45) Date of Patent: Dec. 3, 2013

(54) ANCHOR WITH ANGULAR ADJUSTMENT

(75) Inventor: Ronald P. Hohmann, Jr., Hauppauge, NY (US)

(73) Assignee: MiTek Holdings, Inc., Wilmington, DE (US)

( * ) Notice: Subject to any disclaimer, the term of this patent is extended or adjusted under 35 U.S.C. 154(b) by 110 days.

(21) Appl. No.: 13/112,410

(22) Filed: May 20, 2011

(65) Prior Publication Data

US 2012/0291390 A1 Nov. 22, 2012

(51) Int. Cl.
*E04B 1/02* (2006.01)

(52) U.S. Cl.
USPC ..... 52/565; 52/561; 52/563

(58) Field of Classification Search
USPC ..... 52/565, 561, 563, 570, 571, 701, 703; 411/89, 138, 227
See application file for complete search history.

(56) References Cited

U.S. PATENT DOCUMENTS

| | | | |
|---|---|---|---|
| 1,392,703 | A | 10/1921 | Phillips |
| 1,798,468 | A | 3/1931 | Hartzler et al. |
| 1,854,633 | A | 4/1932 | Stephens |
| 1,942,863 | A | 1/1934 | Johnstone |
| 2,058,148 | A | 10/1936 | Hard |
| 2,130,531 | A | 9/1938 | Arand |
| 2,240,117 | A | 4/1941 | Homolya |
| 2,280,647 | A | 4/1942 | Hawes |
| 2,403,566 | A | 7/1946 | Thorp et al. |
| 2,580,330 | A | 12/1951 | Symons |
| 2,948,045 | A | 8/1960 | Imonetti |
| 2,966,705 | A | 1/1961 | Massey |
| 2,999,571 | A | 9/1961 | Huber |
| 3,277,626 | A | 10/1966 | Brynjolfsson et al. |
| 3,292,336 | A | 12/1966 | Brynjolfsson et al. |
| 3,309,828 | A | 3/1967 | Tribble |
| 3,341,998 | A | 9/1967 | Lucus |
| 3,353,312 | A | 11/1967 | Storch |
| 3,377,764 | A | 4/1968 | Storch |

(Continued)

FOREIGN PATENT DOCUMENTS

| | | |
|---|---|---|
| CA | 2502978 | 1/2009 |
| CH | 279209 | 11/1951 |

(Continued)

OTHER PUBLICATIONS

ASTM WK 2748, Standard Test Method of Determining Air Leakage of Air Barrier Assemblies, Jan. 17, 2005, 15 pgs.

(Continued)

*Primary Examiner* — Basil Katcheves
(74) *Attorney, Agent, or Firm* — Senniger Powers LLP

(57) ABSTRACT

A wall anchor for use in an insulated cavity wall has an elongated body extending from a driven end to a driving end. A threaded portion at the driven end is adapted to be mounted on an inner wythe of a cavity wall structure. A drive head at the driving end has a surface facing the driven end of the wall anchor, with teeth formed on the surface. A collar with at least one aperture for a veneer tie is located near the driving end. The collar has teeth formed on a top surface generally facing the drive head. The teeth of the drive head and the collar are interengaging ratchet teeth, and a spring washer biases the collar against the drive head. The collar can only be rotated relative to the wall anchor in a single direction, with the interengaging ratchet teeth preventing rotation in the opposite direction.

17 Claims, 7 Drawing Sheets

(56) References Cited

U.S. PATENT DOCUMENTS

| | | | | |
|---|---|---|---|---|
| 3,494,090 | A | 2/1970 | Allen | |
| 3,500,713 | A | 3/1970 | Bell | |
| 3,523,395 | A | 8/1970 | Rutter et al. | |
| 3,587,198 | A | 6/1971 | Hensel | |
| 3,707,815 | A | 1/1973 | Molyneux | |
| 3,786,605 | A | 1/1974 | Winfrey | |
| 3,964,226 | A | 6/1976 | Hala et al. | |
| 4,002,001 | A | 1/1977 | Uydess | |
| 4,021,990 | A | 5/1977 | Schwalberg | |
| 4,107,890 | A | 8/1978 | Seghezzi et al. | |
| 4,108,560 | A | 8/1978 | Minogue | |
| 4,305,239 | A | 12/1981 | Geraghty | |
| 4,329,823 | A | 5/1982 | Simpson | |
| 4,350,464 | A | 9/1982 | Brothers | |
| 4,373,314 | A | 2/1983 | Allan | |
| 4,422,617 | A | 12/1983 | Gallis | |
| 4,426,061 | A | 1/1984 | Taggart | |
| 4,430,035 | A | 2/1984 | Rodseth | |
| 4,438,611 | A | 3/1984 | Bryant | |
| 4,473,209 | A | 9/1984 | Gallis et al. | |
| 4,473,984 | A | 10/1984 | Lopez | |
| 4,596,102 | A | 6/1986 | Catani et al. | |
| 4,598,518 | A | 7/1986 | Hohmann | |
| 4,600,344 | A * | 7/1986 | Sutenbach et al. | 411/435 |
| 4,606,163 | A | 8/1986 | Catani | |
| 4,653,244 | A | 3/1987 | Farrell | |
| 4,660,342 | A | 4/1987 | Salisbury | |
| 4,680,913 | A | 7/1987 | Geisen et al. | |
| 4,736,554 | A | 4/1988 | Tyler | |
| 4,764,069 | A | 8/1988 | Reinwall et al. | |
| 4,825,614 | A | 5/1989 | Bennett et al. | |
| 4,852,320 | A | 8/1989 | Ballantyne | |
| 4,869,038 | A | 9/1989 | Catani | |
| 4,869,043 | A | 9/1989 | Hatzinikolas et al. | |
| 4,875,319 | A | 10/1989 | Hohmann | |
| 4,955,172 | A | 9/1990 | Pierson | |
| 4,970,842 | A | 11/1990 | Kappeler et al. | |
| 5,012,624 | A | 5/1991 | Dahlgren | |
| 5,016,855 | A | 5/1991 | Huggins | |
| 5,063,722 | A | 11/1991 | Hohmann | |
| 5,207,043 | A | 5/1993 | McGee et al. | |
| 5,209,619 | A * | 5/1993 | Rinderer | 411/85 |
| 5,347,781 | A | 9/1994 | Hanlon | |
| 5,392,581 | A | 2/1995 | Hatzinikolas et al. | |
| 5,408,798 | A | 4/1995 | Hohmann | |
| 5,433,569 | A * | 7/1995 | Fall et al. | 411/387.3 |
| 5,439,338 | A | 8/1995 | Rosenberg | |
| 5,454,200 | A | 10/1995 | Hohmann | |
| 5,456,052 | A | 10/1995 | Anderson et al. | |
| 5,634,310 | A | 6/1997 | Hohmann | |
| 5,644,889 | A | 7/1997 | Getz | |
| 5,671,578 | A | 9/1997 | Hohmann | |
| RE35,659 | E | 11/1997 | Ernst et al. | |
| 5,816,008 | A | 10/1998 | Hohmann | |
| 5,836,126 | A | 11/1998 | Harkenrider et al. | |
| D406,524 | S | 3/1999 | Steenson et al. | |
| 6,128,883 | A | 10/2000 | Hatzinikolas | |
| 6,131,360 | A | 10/2000 | Dalen | |
| 6,209,281 | B1 | 4/2001 | Rice | |
| 6,279,283 | B1 | 8/2001 | Hohmann et al. | |
| 6,332,300 | B1 | 12/2001 | Wakai | |
| 6,345,472 | B1 | 2/2002 | Taylor | |
| 6,401,406 | B1 | 6/2002 | Komara | |
| 6,502,362 | B1 * | 1/2003 | Zambelli et al. | 52/698 |
| 6,668,505 | B1 | 12/2003 | Hohmann et al. | |
| 6,763,640 | B2 | 7/2004 | Lane | |
| 6,789,365 | B1 | 9/2004 | Hohmann et al. | |
| 6,802,675 | B2 | 10/2004 | Timmons et al. | |
| 6,925,768 | B2 | 8/2005 | Hohmann et al. | |
| 6,941,717 | B2 | 9/2005 | Hohmann et al. | |
| 7,017,318 | B1 | 3/2006 | Hohmann et al. | |
| 7,114,900 | B2 | 10/2006 | Toosky | |
| 7,334,374 | B2 | 2/2008 | Schmid | |
| 7,404,274 | B2 | 7/2008 | Hayes | |
| 7,415,803 | B2 | 8/2008 | Bronner | |
| 7,421,826 | B2 | 9/2008 | Collins et al. | |
| 7,562,506 | B2 | 7/2009 | Hohmann, Jr. | |
| 7,845,137 | B2 | 12/2010 | Hohmann, Jr. | |
| 2002/0100239 | A1 | 8/2002 | Lopez | |
| 2005/0279043 | A1 | 12/2005 | Bronner | |
| 2006/0198717 | A1 | 9/2006 | Fuest | |
| 2008/0141605 | A1 | 6/2008 | Hohmann | |
| 2009/0133357 | A1 | 5/2009 | Richards | |
| 2010/0037552 | A1 | 2/2010 | Bronner | |
| 2011/0047919 | A1 | 3/2011 | Hohmann, Jr. | |
| 2011/0146195 | A1 | 6/2011 | Hohmann, Jr. | |
| 2011/0173902 | A1 | 7/2011 | Hohmann, Jr. et al. | |

FOREIGN PATENT DOCUMENTS

| | | |
|---|---|---|
| DE | 231696 | 6/1909 |
| DE | 1960453 A1 | 6/1970 |
| DE | 2856205 A1 | 7/1980 |
| GB | 2069024 | 8/1981 |

OTHER PUBLICATIONS

Building Envelope Requirements, 780 CMR sec. 1304.3 of chapter 13, Boston, MA, Jan. 1, 2001.

Wire Bond Corp; "Wire-Bond Sure Tie" and "Wire-Bond Clip" Product Catalog Sheet Charlotte, NC, undated.

Heckmann Building Products, Inc., Pos-I-Tie Air Infiltration and Water PenetrationTest, Aug. 2003, http://www.heckmannbuildingprods.com/PosTest.htm.

Heckmann Building Products, Inc., "Wing Nut Pos-I-Tie. "Product Catalogue Sheets, Melrose Park, Illinois, undated.

www.heckmanbuildingprods.com, Heckman General Catalog for 2006, Oct. 28, 2006 pp. 4-5.

* cited by examiner

ANCHOR WITH ANGULAR ADJUSTMENT

FIELD OF THE INVENTION

The present invention generally relates to anchoring systems for insulated cavity walls, and more specifically, a wall anchor that is adjustable for proper positioning of a veneer tie.

BACKGROUND OF THE INVENTION

Anchoring systems for cavity walls are used to secure veneer facings to a building and overcome seismic and other forces, e.g. wind shear, etc. Anchoring systems generally include a wall anchor for insertion into an inner wythe of a cavity wall structure and a veneer tie that is embedded in a mortar joint of an outer wythe or brick veneer. Slight angular and height misalignments in an installed veneer tie can reduce the ability of the anchoring system to transfer tension and compression loads acting on the outer wythe to the backup wall. However, a freely adjustable anchoring system is not preferable, because of the risk of unintentional movement of the anchor prior to connection to the veneer tie.

SUMMARY OF THE INVENTION

In one aspect, a wall anchor for use in a cavity wall to connect to a veneer tie to join an inner wythe and an outer wythe of the cavity wall generally includes an elongated body having a driven end, a driving end, and a longitudinal axis. A collar is mounted on the elongated body for rotation about the longitudinal axis of the elongated body. The collar is adapted for connection to the veneer tie. A rotation control structure operatively engages the collar and elongate body. The rotation control structure permits rotation of the collar in a first direction relative to the elongate body about the longitudinal axis of the elongate body. The rotation control structure prevents rotation of the collar relative to the elongate body about the longitudinal axis of the elongate body in a second direction opposite the first direction.

In another aspect, a wall anchor for use in a cavity wall to connect to a veneer tie to join an inner wythe and an outer wythe of the cavity wall generally includes an elongated body having a driven end, a driving end and a longitudinal axis. The driven end is adapted to be threadedly mounted on the inner wythe of the cavity wall. The elongate body includes a drive head disposed on the driving end of the elongated body. The drive head has a bottom surface facing toward the driven end of the wall anchor. A first set of teeth are formed on the bottom surface of the drive head. A collar is disposed on the elongated body. The collar has wings each having an aperture therein to receive a respective portion of the veneer tie. The collar has a top surface generally facing the drive head and a bottom surface generally facing the driven end of the wall anchor. A second set of teeth are formed on the top surface of the collar. A spring biases the first set of teeth on the bottom surface of the drive head and the second set of teeth on the top surface of the collar into engagement with each other to permit rotation of the collar about the longitudinal axis of the elongate body in a first direction and to prevent rotation of the collar about the longitudinal axis of the elongate body in a second direction opposite the first direction.

In yet another aspect, a wall anchor for use in an insulated cavity wall to connect to a veneer tie to join an inner wythe and an outer wythe of the cavity wall generally includes an elongated body having a driven end adapted to be mounted on the inner wythe of the cavity wall. The elongated body also includes a driving end, a longitudinal axis, a first shaft portion adjacent the driven end and a second shaft portion adjacent the first shaft portion. A drive head is located at the driving end of the elongated body. A collar is disposed on the elongated body and defines at least one aperture adapted to receive a portion of the veneer tie. The collar is rotatable in only one direction relative to the elongated body to angularly orient the at least one aperture. An internal seal is located on the elongated body at the junction of the first shaft portion and the second shaft portion. An external seal is located on the elongated body adjacent the collar.

Other objects and features will be in part apparent and in part pointed out hereinafter.

BRIEF DESCRIPTION OF THE DRAWINGS

Corresponding reference characters indicate corresponding parts throughout the drawings.

DESCRIPTION OF THE PREFERRED EMBODIMENTS

Figure 1:
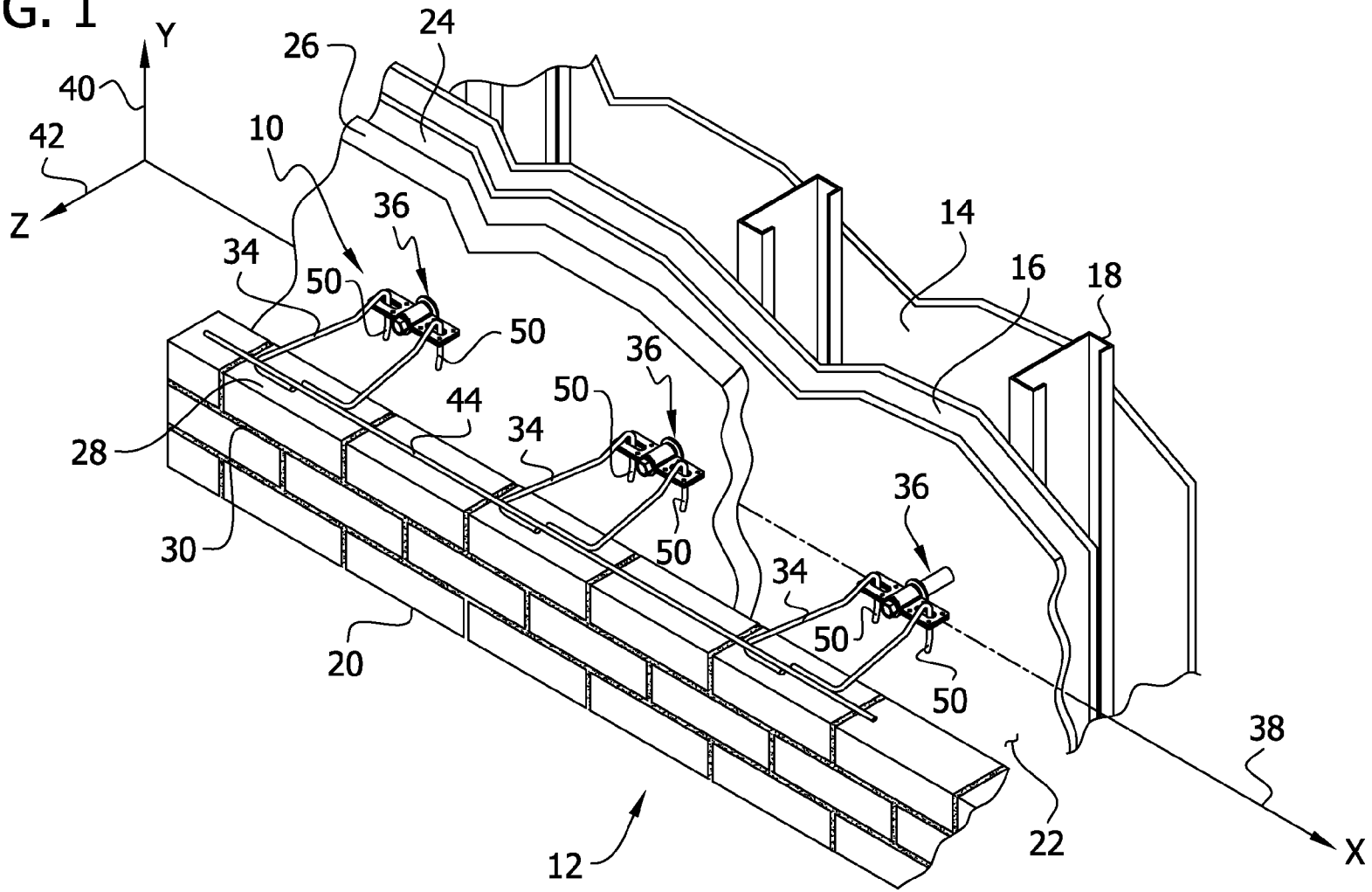
FIG. 1 is a perspective of an anchoring system as applied to a cavity wall with an inner wythe of an insulated dry wall construction and an outer wythe of brick.

Referring to FIG. 1, an anchoring system for cavity walls is shown generally at 10. A cavity wall structure generally indicated at 12 comprises an inner wythe or drywall backup 14 with sheetrock or wallboard 16 mounted on metal studs or columns 18 and an outer wythe or facing wall 20 of brick construction. Between the inner wythe 14 and the outer wythe 20, a cavity 22 is formed. An air/vapor barrier 24 and insulation 26 are attached to an exterior surface of the inner wythe 14.

Successive bed joints 28 and 30 are substantially planar and horizontally disposed and, in accordance with building standards, are approximately 0.375 inches in height in the a typical embodiment. Selective ones of bed joints 28 and 30, which are formed between courses of bricks, are constructed to receive the insertion portion of a veneer tie 34. A wall anchor 36 is threadedly mounted on the inner wythe 14 and is supported by the inner wythe. The wall anchor 36, as described in greater detail below, is adjustable to accommodate the veneer tie 34 and preferably is also configured to minimize air and moisture penetration around the wall anchor/inner wythe interface.

For purposes of the description, the cavity surface 24 of the inner wythe 14 contains a horizontal line or x-axis 38 and intersecting vertical line or y-axis 40. A horizontal line or z-axis 42, normal to the xy-plane, passes through the coordinate origin formed by the intersecting x- and y-axes.

Figure 2:
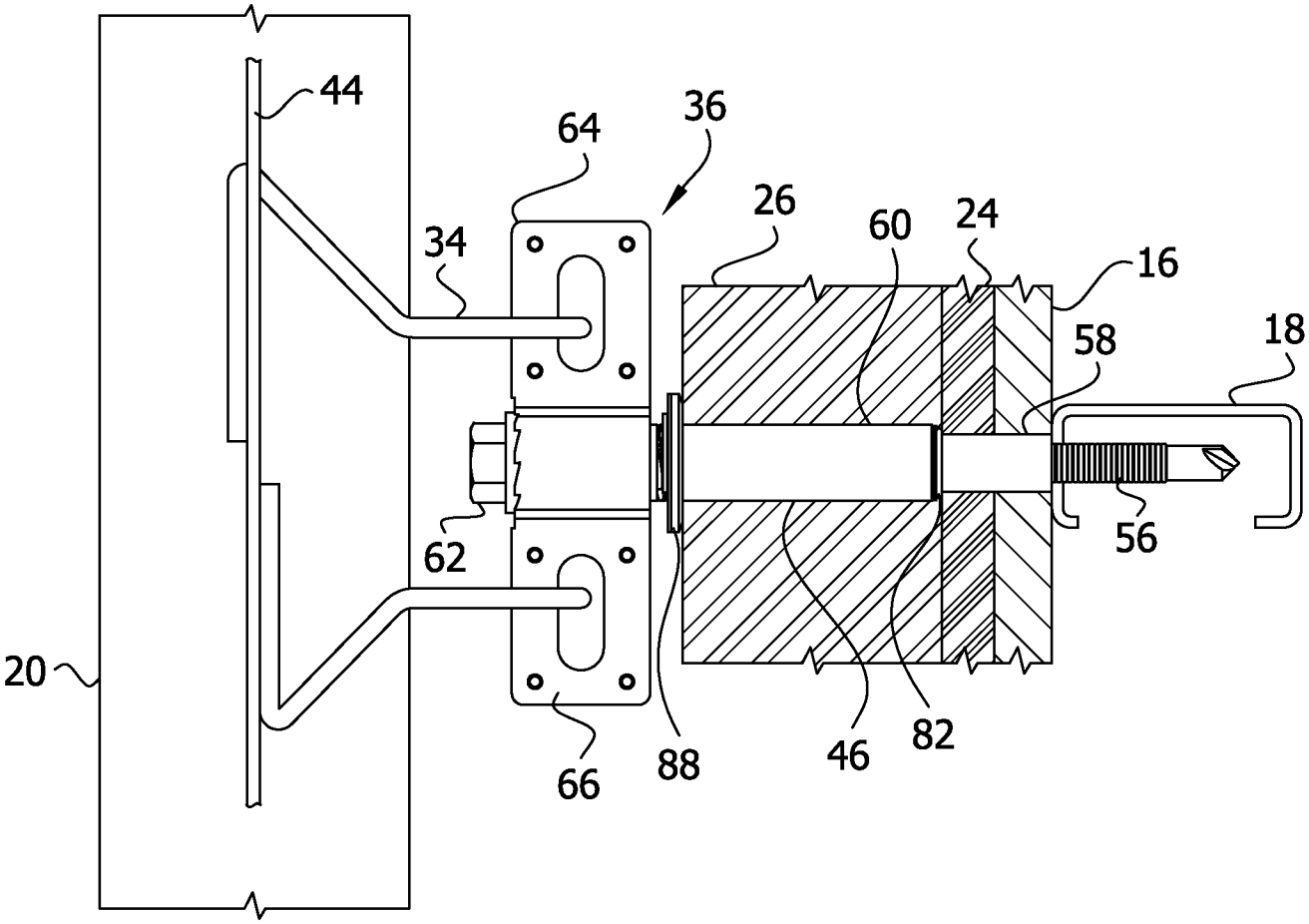
FIG. 2 is a fragmentary elevation, partly in section, looking down from above on an anchoring system in use.

In the illustrated embodiment, the anchoring system 10 includes wall anchor 36, veneer tie 34, and a wire or outer wythe reinforcement 44. At intervals along the exterior surface 24 of the inner wythe 14, wall anchors 36 are driven into place in anchor-receiving channels 46 (see FIG. 2). Anchor-receiving channels 46 can be pre-drilled, or, alternatively, wall anchor 36 can be used to drill its own channel. The wall anchors 36 are positioned so that a longitudinal axis 48 of wall anchor 36 is normal to the xy-plane and taps into column 18. Veneer tie 34 is shown in FIG. 1 as being placed on a course of bricks in preparation for being embedded in the mortar of bed joint 28. The veneer tie 34 is formed of wire and includes pintle connectors 50, as is known in the art. The wire reinforcement 44 is also constructed of a wire, as is known in the art, and preferably conforms to the joint reinforcement requirements of ASTM Standard Specification A951-00, Table 1.

Figure 3:
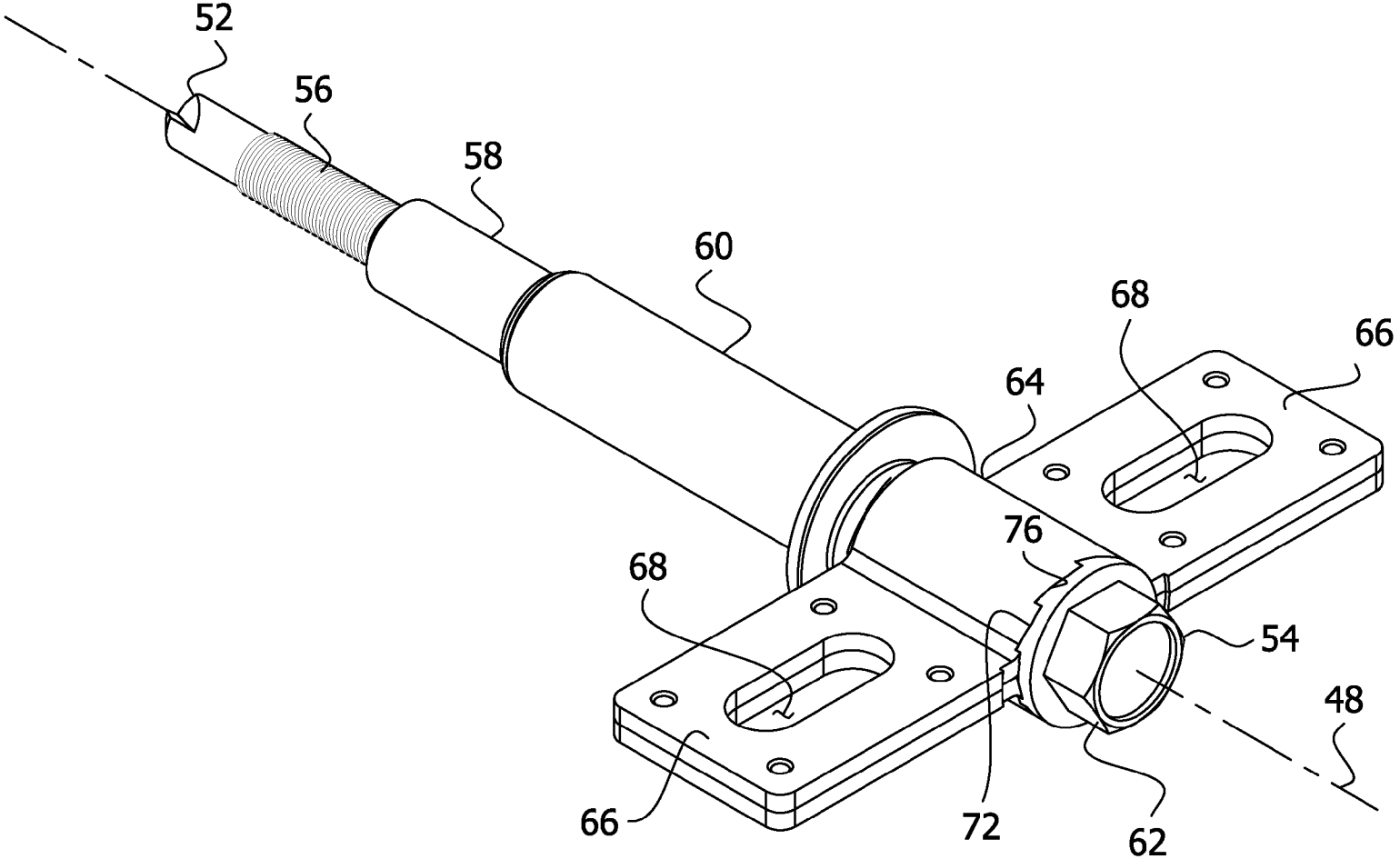
FIG. 3 is a perspective of an anchor with angular adjustment according to the present invention.

As best shown in FIG. 3, the wall anchor 36 includes an elongated body that extends along the longitudinal axis 48 of the anchor from a driven end 52 to a driving end 54. The driven end 52 includes a threaded portion 56. In use, the driven end 52 is driven into column 18, mounting the wall anchor 36 on the inner wythe 14. In the preferred embodiment, the elongated body of the wall anchor 36 includes a dual-diameter barrel with a smaller diameter barrel or first shaft portion 58 toward the driven end 52 and a larger diameter barrel or second shaft portion 60 toward the driving end 54.

A drive head 62 is located at the driving end 54 of the anchor 36. As illustrated, the drive head 62 is a bolt capable of being driven using a conventional chuck, and secures a collar 64 onto the anchor 36. Collar 64 is disposed on the anchor 36 near the driving end 54, adjacent the drive head 62. The collar 64 includes two wings 66, each wing defining an aperture 68 for receiving respective pintle connectors 50 of the veneer tie 34. The collar may have any number of wings, but generally one or two is most practical. As shown, the pintle connectors 50 of the veneer tie 34 are each inserted into the aperture 68 of a respective one of the wings 66, thereby securing the veneer tie to the wall anchor 36. Positioning the pintle connectors 50 of the veneer tie 34 in the wings 66 has the effect of spreading stresses acting on the outer wythe 20 to avoid pin-point loading, or loading of the stresses on a single point.

Collar 64 is rotatable about the anchor 36 to adjust the angular orientation of the apertures 68 that accommodate the veneer tie 34 to overcome slight angular and height misalignments that can be problematic for the anchoring system 10. However, rotation of the collar 64 about the anchor 36 is limited to one direction in order to prevent unintentional rotation of the collar. In the preferred embodiment, as described below, rotation in the permitted direction is achieved by overcoming the bias of a spring washer, so that unintentional rotation of the collar is prevented, even in the permitted direction of rotation. Furthermore, rotation of collar 64 does not cause the collar to move longitudinally along the anchor 36 because there is no threaded connection between the collar and the anchor.

Figure 4:
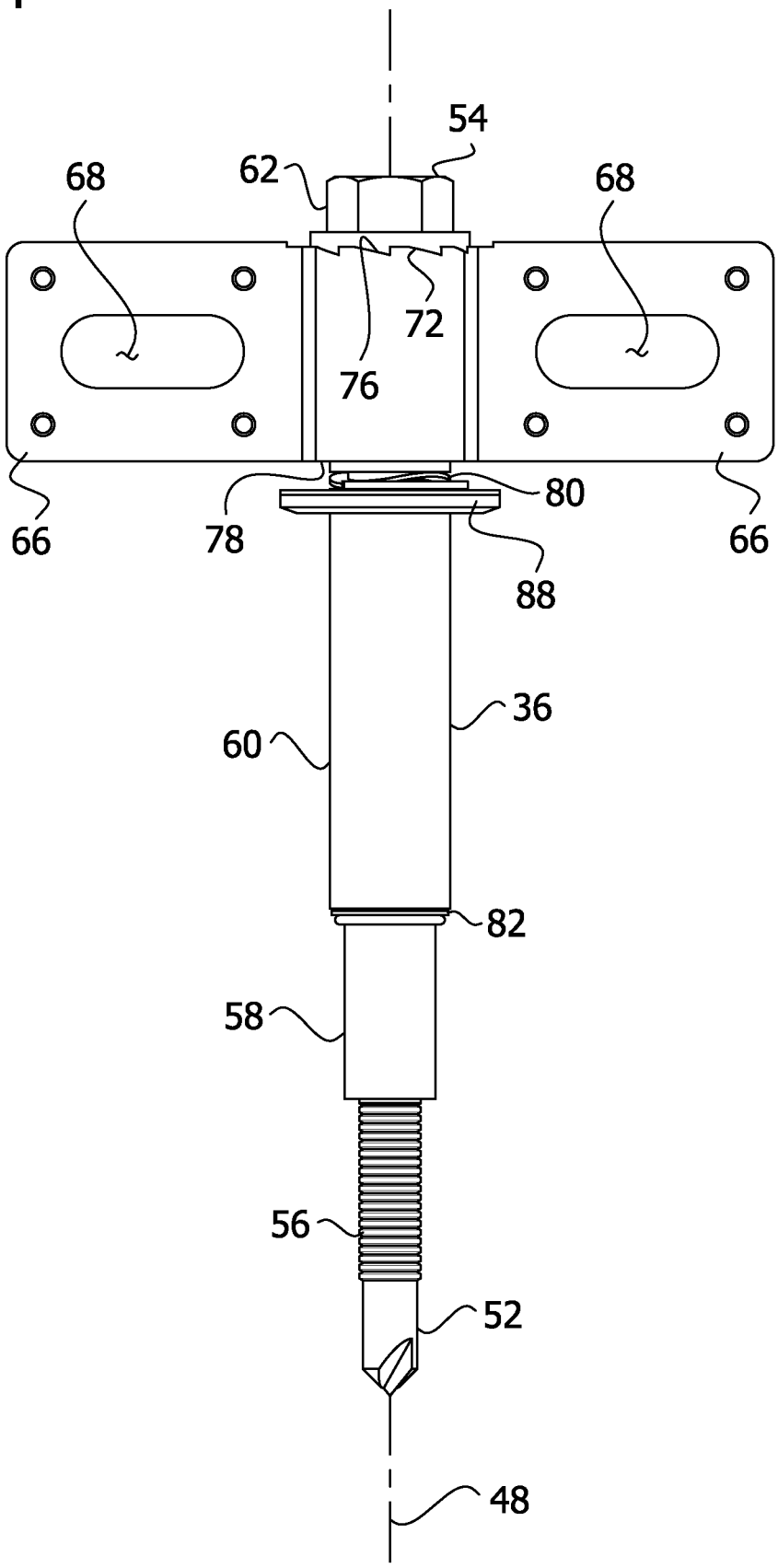
FIG. 4 is a top view thereof.
Figure 5:
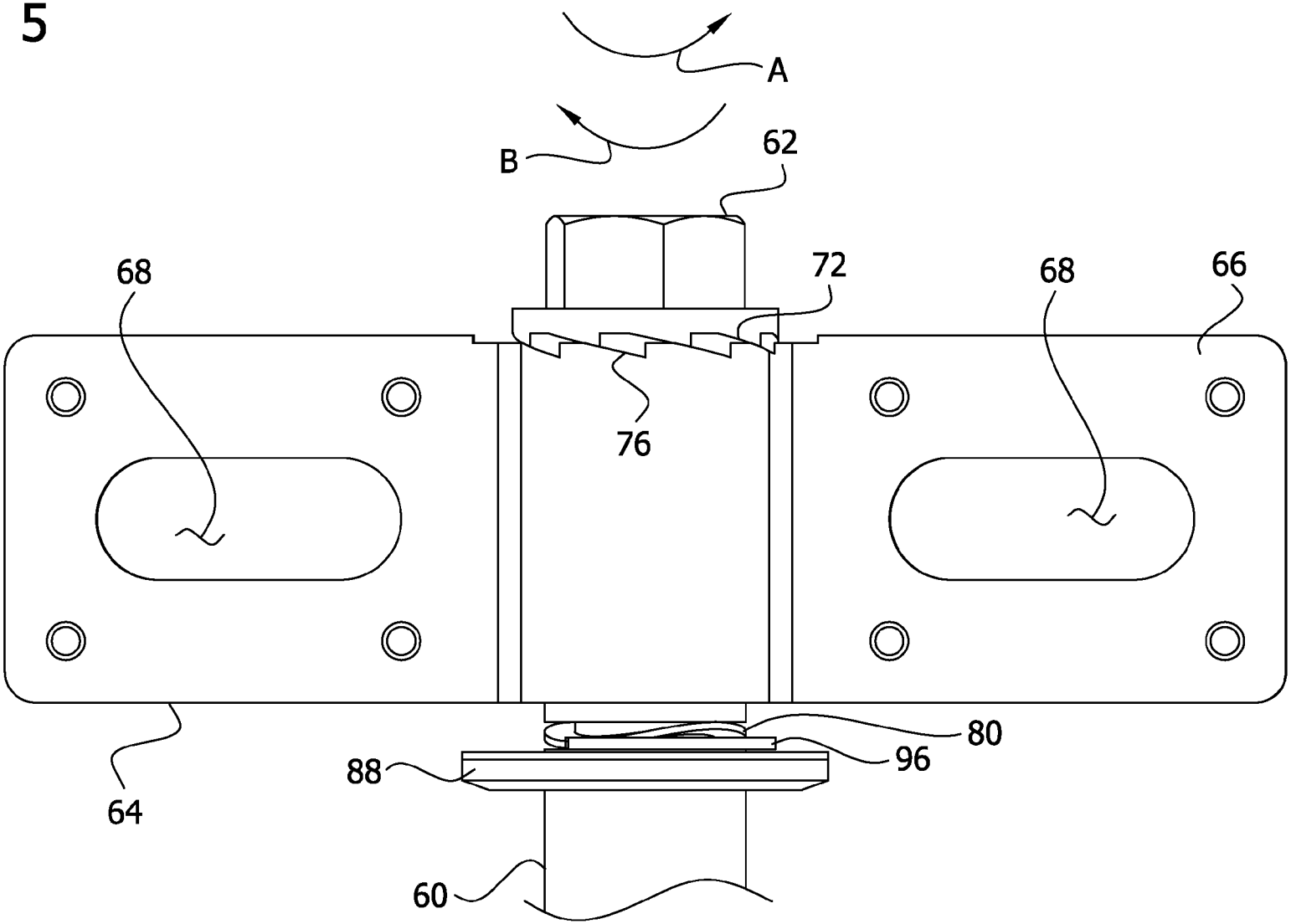
FIG. 5 is an exploded view thereof.
Figure 6:
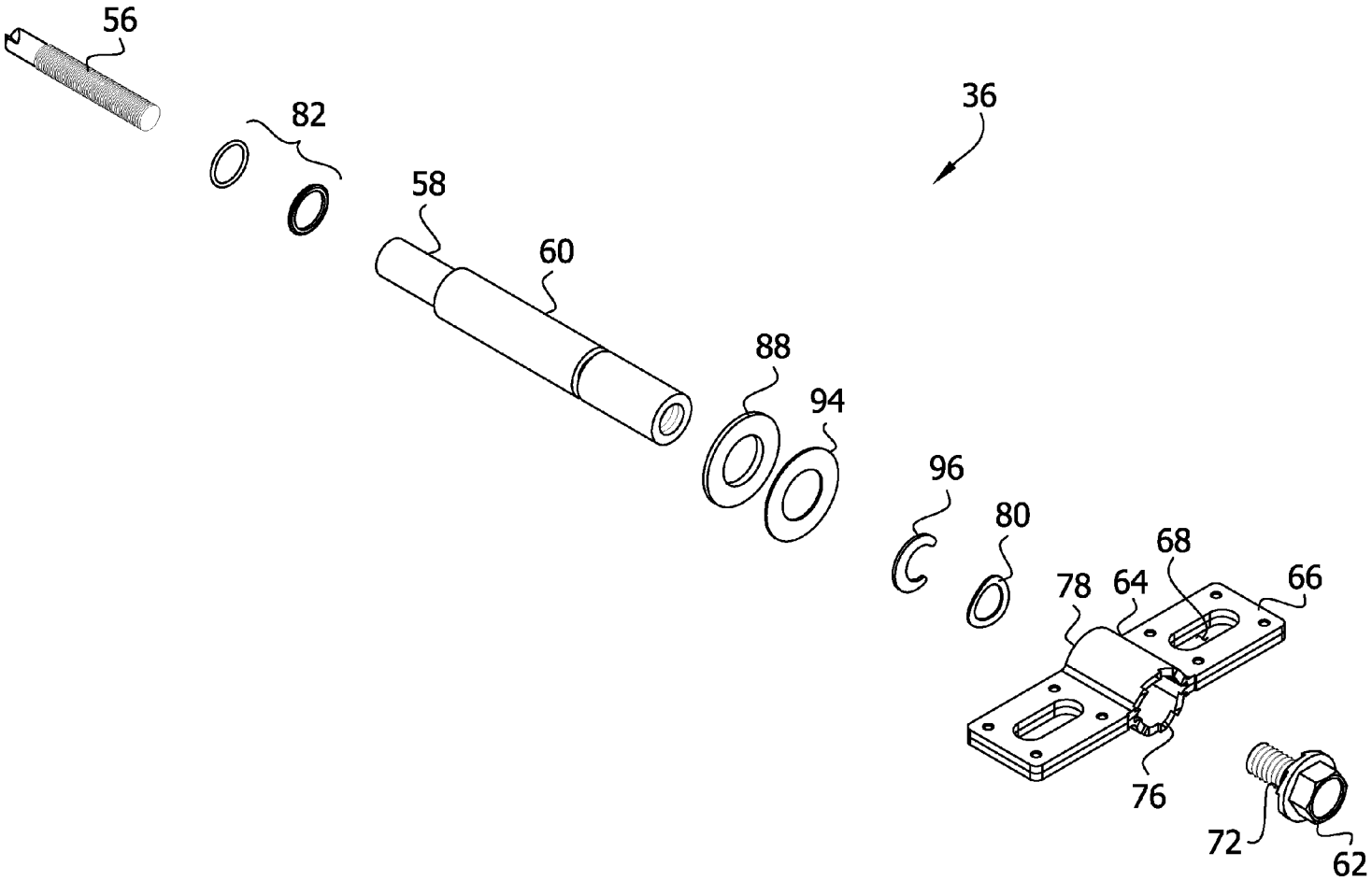
FIG. 6 is a fragmentary view thereof, illustrating the permitted rotational movement of a collar about the wall anchor.

Rotation control structure of the anchor 36 limits rotation of the collar 64 about the longitudinal axis 48 of the anchor to only one direction. As shown in FIGS. 3, 4, and 6, drive head 62 has a bottom surface facing the driven end 52 of the wall anchor 36. The surface includes teeth 72 (broadly, "first ratchet structure"). The collar 64 has a top surface generally facing the drive head 62 that includes teeth 76 (broadly, "second ratchet structure"). The teeth 76 on the top surface of the collar 64 engage the teeth 72 on the surface of the drive head 62. The teeth 72, 76 are configured as interengaging ratchet teeth, so that the collar 64 can rotate about the anchor 36 in only one direction. A spring adjacent a bottom surface 78 of the collar 64 biases the collar against the drive head 62. As illustrated, the spring can be in the form of a spring washer 80, such as a Belleville washer. The spring can have other forms within the scope of the present invention. When the collar 64 is turned in one direction, generally indicated by arrow A, the teeth 72, 76 will separate and push the collar down against the bias of the spring washer 80 to allow the collar to turn (see FIG. 6). However, if a user attempts to turn collar 64 in the opposite direction, generally indicated by arrow B, the teeth 72, 76 lock to prevent movement in that direction. Other biasing arrangements or configurations allowing rotation in only one direction are within the scope of the present invention.

As illustrated, a wall anchor 36 according to the present invention can also include a dual seal system to prevent air and moisture penetration through the cavity wall structure 12. Preferably a stabilizing neoprene fitting or internal seal 82 is located at the junction of first and second shaft portions 58, 60. When fully driven into column 18, the threaded portion 56 and first shaft portion 58 of wall anchor 36 pierce the sheetrock or wallboard 16 and air/vapor barrier 24, extending through an inner portion of anchor-receiving channel 46. The internal seal 82 covers the insertion point of the first shaft portion 58 and the threaded portion 56 through the inner channel portion, precluding air and moisture penetration through the channel and maintaining the integrity of air/vapor barrier 24.

Preferably, another stabilizing neoprene fitting or external seal 88 is located at the junction of the drive head 62 and the second shaft portion 60. Upon installation of wall anchor 36 through rigid insulation 26, the larger barrel portion 60 is forced into a press fit relationship with an external portion of anchor-receiving channel 46. Stabilization of this stud-type wall anchor 36 is attained by larger barrel portion 60 and internal neoprene fitting 82 completely filling the external channel portion, with external neoprene fitting 88 capping the opening of the channel 46 into cavity 22 and clamping wall anchor 36 in place. This arrangement does not leave any end play or wiggle room for pin-point loading of the wall anchor and therefore does not loosen over time. With stabilizing fitting or external seal 88 in place, the insulation integrity within the cavity wall is maintained. A rigid washer 94 can be located adjacent the external seal 88 to protect the seal and provide a rigid reaction surface for the spring washer 80. Additionally, a lock washer 96 holds the external seal 88 and rigid washer 94 in place on the elongated body. It will be understood that the seal system may be omitted or have a different configuration than described within the scope of the present invention.

In producing wall anchor 36, the length of the smaller diameter barrel 58 less the height of the internal seal 82 is dimensioned to match the combined thickness of the air/vapor barrier 24 and the wallboard 16. Similarly, the length of the larger diameter barrel 60 plus the height of the internal seal 82 is dimensioned to match the thickness of insulation 26. This configuration allows for sealing of the anchor-receiving channels 46 upon insertion of wall anchors 36. However, other configurations of the anchor 36 do not depart from the scope of the present invention.

Figure 7:
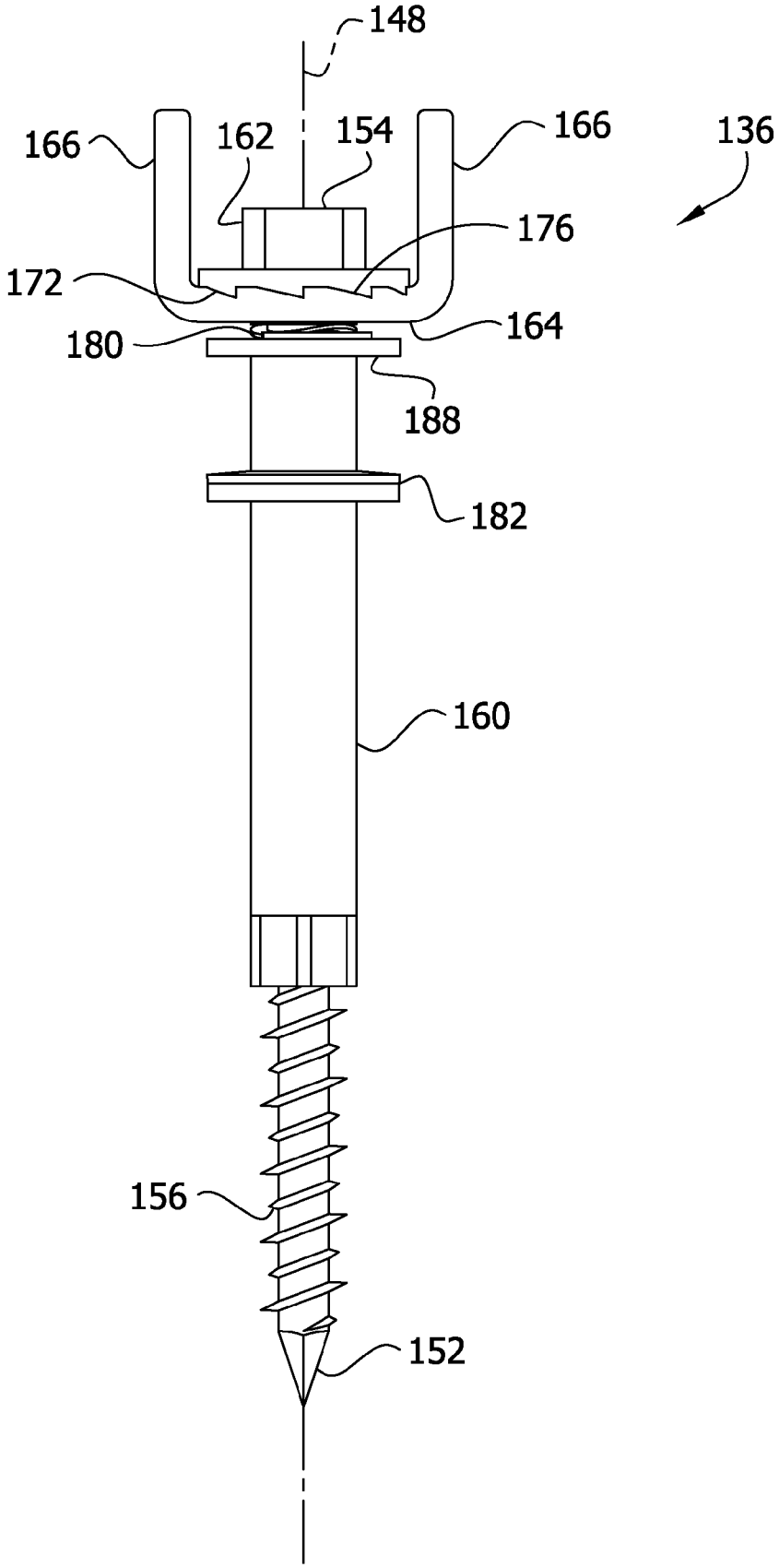
FIG. 7 is a top view of a second embodiment of an anchor with angular adjustment according to the present invention.

A second embodiment of a wall anchor having angular adjustment is illustrated in FIG. 7. Wall anchor 136 is substantially similar to wall anchor 36 described above, with differences as pointed out herein.

Wall anchor 136 includes an elongated body that extends along the longitudinal axis 148 of the anchor from a driven end 152 to a driving end 154. The driven end 152 includes a threaded portion 156. Wall anchor 136 is used as described above with reference to wall anchor 36. Wall anchor 136 includes a single diameter barrel 160, though the anchor could include a dual-diameter barrel as disclosed above.

A drive head 162 is located at the driving end 154 of the anchor 136. As illustrated, the drive head 162 is a bolt capable of being driven using a conventional chuck, and secures a collar 164 onto the anchor 136. The collar 164 includes two wings 166, each wing defining an aperture (not shown) for receiving pintle connectors of a veneer tie, as described above. Unlike anchor 36 described above, the wings 166 of anchor 136 extend toward the drive head 162 of the anchor. This arrangement facilitates connection to veneer ties having different configurations. Collar 164, like collar 64 described above, is rotatable in a single direction about the anchor 136 to adjust the angular orientation of the apertures that accommodate the veneer tie to overcome slight angular and height misalignments.

Rotation control structure of the anchor 136 limits rotation of the collar 164 about the longitudinal axis 148 of the anchor to only one direction. The collar 164 and drive head 162 include interengaging ratchet teeth 172, 176, and a spring washer 180 to allow rotation of the collar in only one direction, as described above. Other biasing arrangements or configurations allowing rotation in only one direction are within the scope of the present invention. Wall anchor 136 can also include seals 182, 188, which function as seals 82, 88, described above, to preclude air and moisture penetration and maintain the integrity of an air/vapor barrier upon installation of the anchor. It will be understood that the seal system may be omitted or have a different configuration than described within the scope of the present invention.

Having described the invention in detail, it will be apparent that modifications and variations are possible without departing from the scope of the invention defined in the appended claims.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above products without departing from the scope of the invention, it is intended that all matter contained in the above description and shown in the accompanying drawings shall be interpreted as illustrative and not in a limiting sense.

What is claimed is:

1. A wall anchor for use in a cavity wall to connect to a veneer tie to join an inner wythe and an outer wythe of the cavity wall, the wall anchor comprising:

an elongated body having a driven end, a driving end and a longitudinal axis; and a collar mounted on the elongated body for rotation about the longitudinal axis of the elongated body, the collar being adapted for connection to the veneer tie, the collar including an aperture for receiving a portion of the veneer tie to connect the veneer tie to the wall anchor;

rotation control structure operatively engaging the collar and elongated body to permit rotation of the collar in a first direction relative to the elongated body about the longitudinal axis of the elongated body and to prevent rotation of the collar relative to the elongated body about the longitudinal axis of the elongated body in a second direction opposite the first direction.

2. The wall anchor of claim 1 wherein the rotation control structure comprises first ratchet structure associated with the elongated body and second ratchet structure associated with the collar, the first and second ratchet structures being engaged to permit rotation of the collar about the longitudinal axis of the elongated body in the first direction and to block rotation of the collar about the longitudinal axis of the elongated body in the second direction.

3. The wall anchor of claim 2 wherein the collar is mounted on the elongated body for movement along the longitudinal axis of the elongated body.

4. The wall anchor of claim 3 further comprising a spring for biasing the collar so that the second ratchet structure is held in engagement with the first ratchet structure.

5. The wall anchor of claim 4 wherein the spring comprises a spring washer disposed around the longitudinal axis of the elongated body.

6. The wall anchor of claim 4 wherein the first ratchet structure comprises ratchet teeth formed on the elongated body and the second ratchet structure comprises teeth formed on the collar.

7. The wall anchor of claim 1, wherein the collar and the elongated body are free of threaded connection.

8. The wall anchor of claim 1 wherein the collar includes wings projecting outwardly therefrom, each wing having an aperture for receiving a portion of the veneer tie to connect the veneer tie to the wall anchor.

9. The wall anchor of claim 1 further comprising a drive head located at the driving end of the elongated body, wherein the rotation control structure is associated with the drive head.

10. The wall anchor of claim 1 further comprising a spring for biasing the collar toward the driving end of the elongated body.

11. A wall anchor for use in a cavity wall to connect to a veneer tie to join an inner wythe and an outer wythe of the cavity wall, the wall anchor comprising:

an elongated body having a driven end, a driving end and a longitudinal axis, the driven end being adapted to be threadedly mounted on the inner wythe of the cavity wall, the elongated body including a drive head disposed on the driving end of the elongated body, the drive head having a bottom surface facing toward the driven end of the wall anchor, and a first set of teeth formed on the bottom surface of the drive head;

a collar disposed on the elongated body, the collar having wings each having an aperture therein to receive a respective portion of the veneer tie, the collar having a top surface generally facing the drive head and a bottom surface generally facing the driven end of the wall anchor, wherein a second set of teeth are formed on the top surface of the collar; and a spring for biasing the first set of teeth on the bottom surface of the drive head and the second set of teeth on the top surface of the collar into engagement with each other for permitting rotation of the collar about the longitudinal axis of the elongated body in a first direction and preventing rotation of the collar about the longitudinal axis of the elongated body in a second direction opposite the first direction.

12. The wall anchor of claim 11 wherein the spring comprises a spring washer disposed on the elongated body adjacent the bottom surface of the collar.

13. The wall anchor of claim 11, wherein the elongated body comprises a first shaft portion located near the driven end and a second shaft portion located near the driving end, the first and second shaft portions being adjacent to each other.

14. The wall anchor of claim 13, wherein the second shaft portion has a substantially larger diameter than the first shaft portion.

15. The wall anchor of claim 14 further comprising an internal seal disposed on the elongated body at the junction of the first shaft portion and the second shaft portion, wherein the internal seal is adapted to seal a channel formed by insertion of the wall anchor into a wall, precluding water and vapor penetration therethrough.

16. The wall anchor of claim 11 further comprising an external seal disposed on the wall anchor adjacent the bottom surface of the collar, wherein the external seal is adapted to seal a channel formed by insertion of the wall anchor into a wall, precluding water and vapor penetration therethrough.

17. A wall anchor for use in an insulated cavity wall to connect to a veneer tie to join an inner wythe and an outer wythe of the cavity wall, the wall anchor comprising:

an elongated body having a driven end adapted to be mounted on the inner wythe of the cavity wall, a driving end, a longitudinal axis, a first shaft portion adjacent the driven end, and a second shaft portion adjacent the first shaft portion;

a drive head located at the driving end of the elongated body;

a collar disposed on the elongated body and defining at least one aperture adapted to receive a portion of the veneer tie, wherein the collar is rotatable in only one direction relative to the elongated body to angularly orient the at least one aperture;

an internal seal located on the elongated body at the junction of the first shaft portion and the second shaft portion; and an external seal located on the elongated body adjacent the collar.

* * * * *